US012110777B2

(12) United States Patent
Alali et al.

(10) Patent No.: US 12,110,777 B2
(45) Date of Patent: Oct. 8, 2024

(54) AUTO-CORRECTION FOR WATER CUT MEASUREMENTS FROM MULTI-PHASE FLOWMETER IN UNDERSATURATED OIL WELLS

(71) Applicant: Saudi Arabian Oil Company, Dhahran (SA)

(72) Inventors: Mohammed H. Alali, Al Qatif (SA); Anas A. Shuaibi, Dammam (SA); Abdulaziz S. Nuaim, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 32 days.

(21) Appl. No.: 17/668,129

(22) Filed: Feb. 9, 2022

(65) Prior Publication Data

US 2023/0250717 A1 Aug. 10, 2023

(51) Int. Cl.

| | |
|---|---|
| ***E21B 43/38*** | (2006.01) |
| ***E21B 43/12*** | (2006.01) |
| ***E21B 47/07*** | (2012.01) |
| ***E21B 49/08*** | (2006.01) |

(52) U.S. Cl.

CPC ..... *E21B 43/385* (2013.01); *E21B 43/121* (2013.01); *E21B 49/0875* (2020.05); *E21B 47/07* (2020.05)

(58) Field of Classification Search

CPC .. E21B 43/385; E21B 43/121; E21B 49/0875; E21B 47/07

See application file for complete search history.

(56) References Cited

U.S. PATENT DOCUMENTS

| | | | | |
|---|---|---|---|---|
| 1,320,564 | A * | 11/1919 | Mortensen | B60L 15/12 318/274 |
| 9,671,524 | B2 * | 6/2017 | Abitrabi | G01V 9/00 |
| 11,320,564 | B1 * | 5/2022 | Hu | E21B 49/00 |
| 2013/0035919 | A1 * | 2/2013 | Al-Shammari | G06F 30/20 703/10 |
| 2013/0173168 | A1 * | 7/2013 | Abitrabi | E21B 43/32 702/6 |
| 2021/0301659 | A1 * | 9/2021 | Al Shahri | E21B 47/06 |
| 2021/0340869 | A1 * | 11/2021 | Syresin | E21B 49/0875 |

FOREIGN PATENT DOCUMENTS

| | | | | |
|---|---|---|---|---|
| CN | 102812203 B | * | 4/2016 | E21B 43/00 |
| GB | 2595969 A | * | 12/2021 | E21B 41/0092 |
| WO | WO-2012134497 A1 | * | 10/2012 | E21B 43/00 |

OTHER PUBLICATIONS

Delvaux et al., "Combination of Dual-Energy Gamma Ray/Venturi Multiphase Flowmeter and Phase Splitter for Application in Very High Gas Volume Fraction Environment," presented at the Abu Dhabi International Conference and Exhibition, Abu Dhabi, UAE, Oct. 2004, 8 pages.

* cited by examiner

*Primary Examiner* — Steven L Yeninas
*Assistant Examiner* — Dilara Sultana
(74) *Attorney, Agent, or Firm* — Fish & Richardson P.C.

(57) ABSTRACT

Systems and methods include a computer-implemented method for determining a gas-oil rate (GOR) for an oil well. A measured GOR is determined for an oil well. A measured water cut (WC) is determined for the oil well. An initial solution of the GOR is determined for the oil well. A corrected WC is determined for the oil well based on a function of the measured GOR, the measured WC, and the initial solution of the GOR.

20 Claims, 3 Drawing Sheets

AUTO-CORRECTION FOR WATER CUT MEASUREMENTS FROM MULTI-PHASE FLOWMETER IN UNDERSATURATED OIL WELLS

TECHNICAL FIELD

The present disclosure applies to obtaining measurements when producing from oil wells.

BACKGROUND

In oil wells, a multi-phase flowmeter (MPFM) is usually used to measure the flow rate and the fractional flow rate for each phase. Due to the variability of produced water properties, the MPFM sometimes erroneously estimates the water fraction (or water cut) and ultimately the fractional flow rate for each phase.

SUMMARY

The present disclosure describes techniques that can be used for determining a corrected water cut for an oil well. In some implementations, a computer-implemented method includes the following. A measured gas-oil rate (GOR) is determined for an oil well. A measured water cut (WC) is determined for the oil well. An initial solution of the GOR is determined for the oil well. A corrected WC is determined for the oil well based on a function of the measured GOR, the measured WC, and the initial solution of the GOR.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Incorrect water cut measurements from a multi-phase flowmeter (MPFM) can be corrected. This can be done, for example, by using the deviation in the gas/oil ratio (GOR) from the original GOR to correct the water cut measurement. This correction technique can be implemented with respect to historical measurements in which an error in water cut measurements has been observed. Correction techniques based on historical measurements can provide a consistent match with the correct measurements, such as verification conducted using a separator test, considered to be an accurate measurement method. Techniques for correcting water cut measurements can help upstream organizations that operate oil wells by helping to make measurements more accurate and reliable. The techniques can use deviations in the GOR measurement of the MPFM for oil wells producing from under-saturated reservoirs to correct deviations in water-cut measurements. An equation was derived that relates the deviation in the GOR to the deviation in the water cut. The measured GOR can replace conventional solutions that determine GOR from a lab measurement. Normalizing logic can be used in the derived equation to ensure the equation is more stable and does not provide out-of-range values.

The details of one or more implementations of the subject matter of this specification are set forth in the Detailed Description, the accompanying drawings, and the claims.

Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for determining a corrected water cut for an oil well. The techniques can include a gas/oil ratio (GOR)-based technique used to correct incorrect water cut measurements from a multi-phase flowmeter (MPFM) (e.g., a gamma-ray-based MPFM). This technique can be applied to oil wells flowing in under-saturated conditions, for example. The deviation in the gas measurements, which is supposed to be constant with time, can be used to correct the deviation in the watercut measurements.

The present disclosure describes solutions to the problem of erroneous estimates determined by an MPFM of water fraction (or water cut) and ultimately the fractional flow rate for each phase of an oil well. The solution provides a technique for self-correcting the erroneous reading without any need for extra measurements or tools. The technique makes use of the science behind a dual-gamma ray (GR)-based MPFM to self-correct the deviation in water cut measurements. For example, GR-based MPFMs work on the basis that each phase (oil, water, and gas) has different gamma attenuation on different gamma energy levels. By applying two levels of energy, a solution triangle can be constructed as shown in FIG. 1.

Figure 1:
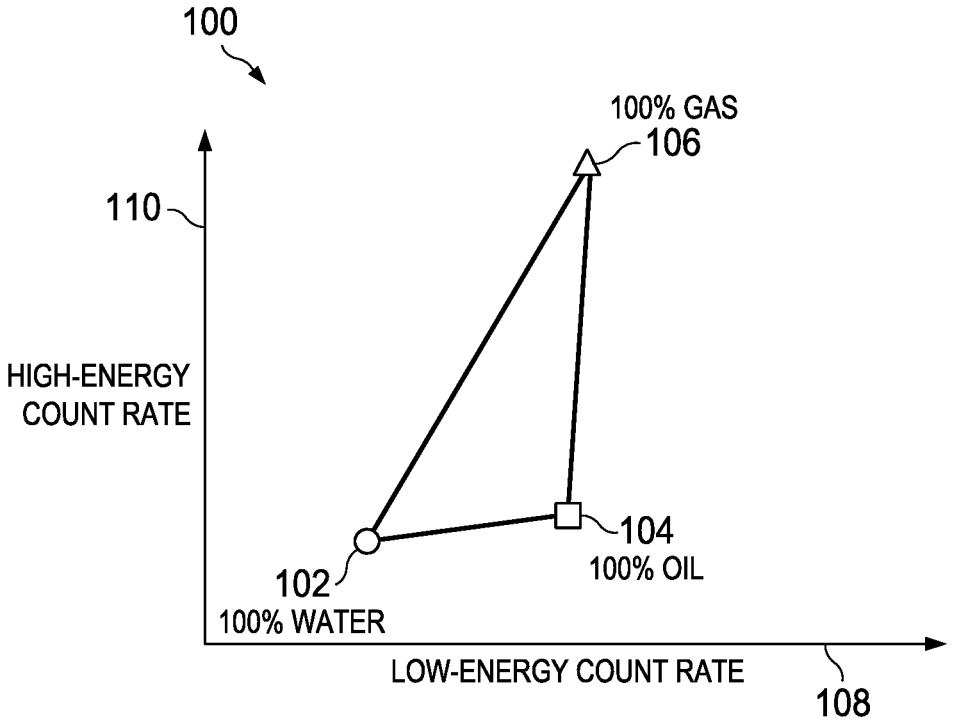
FIG. 1 is a graph showing an example plot of multiple phases of an oil well, according to some implementations of the present disclosure.

FIG. 1 is a graph 100 showing an example plot of multiple phases of an oil well, according to some implementations of the present disclosure. The graph 100 includes a 100% water point 102, a 100% oil point 104, and a 100% gas point 106. Each point is plotted relative to a low-energy count rate 108 and a high-energy count rate 110. The triangular shape formed by points 102, 104, and 106 represents the actual measurement from the meter for each phase. During operation of the meter, each measurement containing the three phases (oil, water and gas) will lie within the triangle. From this measurement, the fraction of each phase can be calculated. The fraction of each phase is represented by the distance between the measurement point and the corner that represents 100% from that phase where the sum of the fractions of the three phases equals 1.

Measurements can be made, for example, in oil wells operating in under-saturated conditions (e.g., where the GOR is constant). As a result, the measurements can be expected to fall on a tie-line that connects the 100% water point and a point on the gas-oil tie-line (depending on the GOR). Knowing this information in advance makes it possible to use the deviation from this tie-line to correct for incorrect water cut measurement. The following formula can be used to estimate the corrected water cut:

$$WC_{corrected} = 100 - \left(\frac{GOR^* \times (100 - WC^*)}{R_{si}}\right) \quad (1)$$

where: GOR* is the measured GOR from the MPFM, WC* is the measured WC from the MPFM, and $R_{si}$ is the initial solution GOR from a pressure/volume/temperature (PVT) study. If the solution GOR is not available, then the initial measured GOR from the MPFM (before water arrival) can be used.

Improvements to the correction equation can be made to make the solution more stable. The improvements can be as follows.

If:

$$100 - \left(\frac{GOR^* \times (100 - WC^*)}{R_{si}}\right) > 100, \text{ then } WC_{corrected} = 100 \quad (2)$$

And if:

$$100 - \left(\frac{GOR^* \times (100 - WC^*)}{R_{si}}\right) < 0, \text{ then } WC_{corrected} = 0 \quad (3)$$

Then, in general, as shown in Equation (1):

$$WC_{corrected} = 100 - \left(\frac{GOR^* \times (100 - WC^*)}{R_{si}}\right) \quad (4)$$

Figure 2:
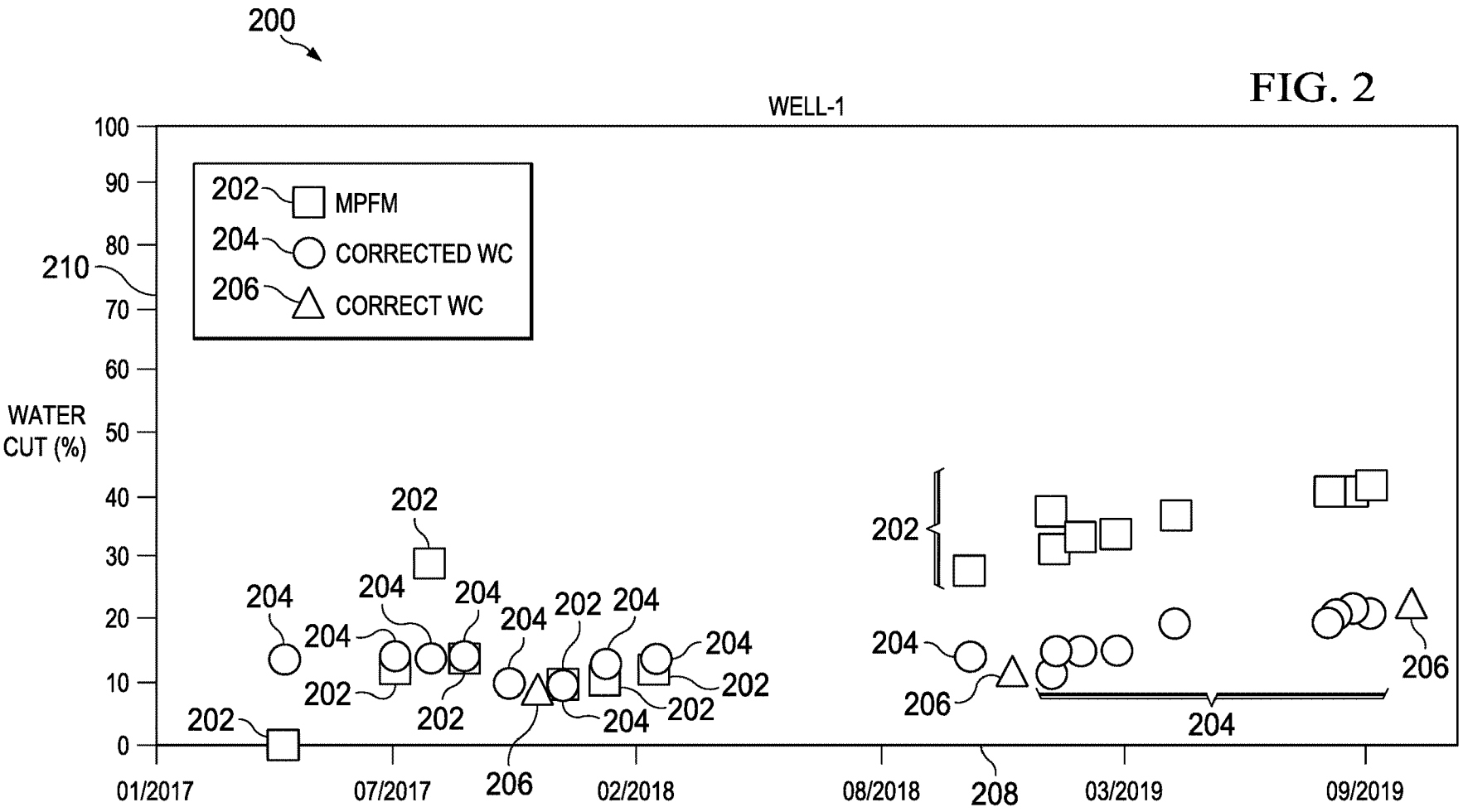
FIG. 2 is a graph showing plotted water cut points, according to some implementations of the present disclosure.

FIG. 2 is a graph 200 showing plotted water cut points, according to some implementations of the present disclosure. The graph 200 includes MPFM measurements 202, corrected WC measurements 204, and a WC measurements from a separator test which is considered the reference for a correct water cut measurement 206. The points are plotted relative to time 208 and a water cut percentage 210. The graph 200 shows a comparison between MPFM measurements 202 and the corrected WC measurements 204. The plot shows that the corrected values match very well with the actual water-cut measurements coming from a testing separator (correct WC measurements 206).

Figure 3:
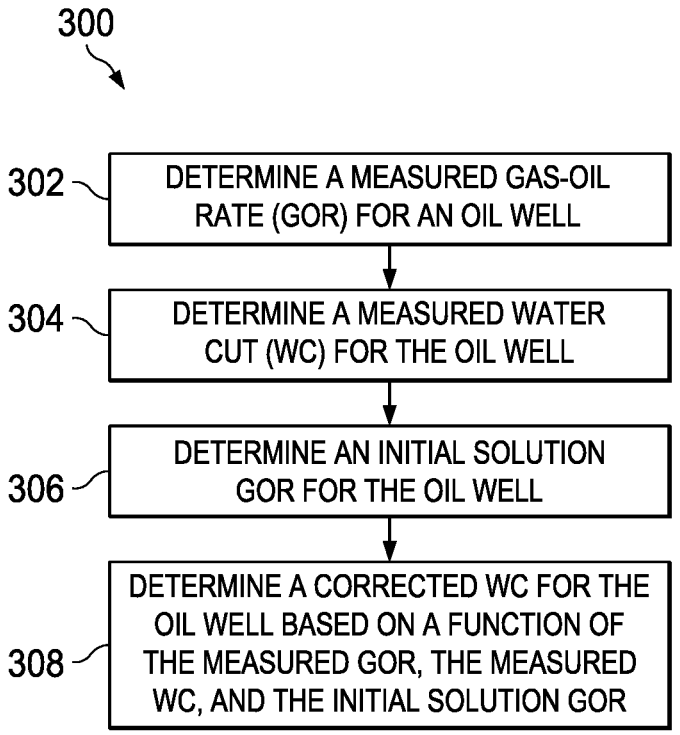
FIG. 3 is a flowchart of an example of a method for determining a corrected water cut for an oil well, according to some implementations of the present disclosure.

FIG. 3 is a flowchart of an example of a method 300 for determining a corrected water cut for an oil well, according to some implementations of the present disclosure. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order.

At 302, a measured gas-oil rate (GOR) is determined for an oil well, for example, using an MPFM. As an example, determining the measured GOR for the oil well can include determining the measured GOR when the oil well is operated in under-saturated conditions. From 302, method 300 proceeds to 304.

At 304, a measured water cut (WC) is determined for the oil well. From 304, method 300 proceeds to 306.

At 306, an initial solution GOR is determined for the oil well. For example, a pressure/volume/temperature (PVT) study can be performed on the oil well, and the initial solution GOR can be determined based on the PVT study. From 306, method 300 proceeds to 308.

At 308, a corrected WC is determined for the oil well based on a function of the measured GOR, the measured WC, and the initial solution GOR. For example, the corrected WC can be determined as described with reference to Equations (1) and (4). In some implementations, determining the corrected WC can include determining a ceiling value for the corrected WC when the function produces a corrected WC above the ceiling value, for example, as described with reference to Equation (2). In some implementations, determining the corrected WC can include determining a floor value for the corrected WC when the function produces a corrected WC below the floor value, for example, as described with reference to Equation (3). After 308, method 300 can stop.

In some implementations, method 300 includes generating a graph relating values of phases of the oil well, including a water phase, an oil phase, and a gas phase. The generated graph should replace the graph previously defined in the MPFM to make sure that the measurements are accurate.

In some implementations, in addition to (or in combination with) any previously-described features, techniques of the present disclosure can include the following. Customized user interfaces can present intermediate or final results of the above described processes to a user. The presented information can be presented in one or more textual, tabular, or graphical formats, such as through a dashboard. The information can be presented at one or more on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change or an improvement in overall production of an oil well. The suggestions, when implemented by the user, can improve the accuracy of calculations, improve models, and solve problems related to efficiency, performance, reliability, costs, downtime, and the need for human interaction. In some implementations, the suggestions can be implemented in real-time, such as to provide an immediate or near-immediate change in operations or in a model. In some implementations, values of parameters or other variables that are determined can be used automatically (such as through using rules) to implement changes in oil well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 4:
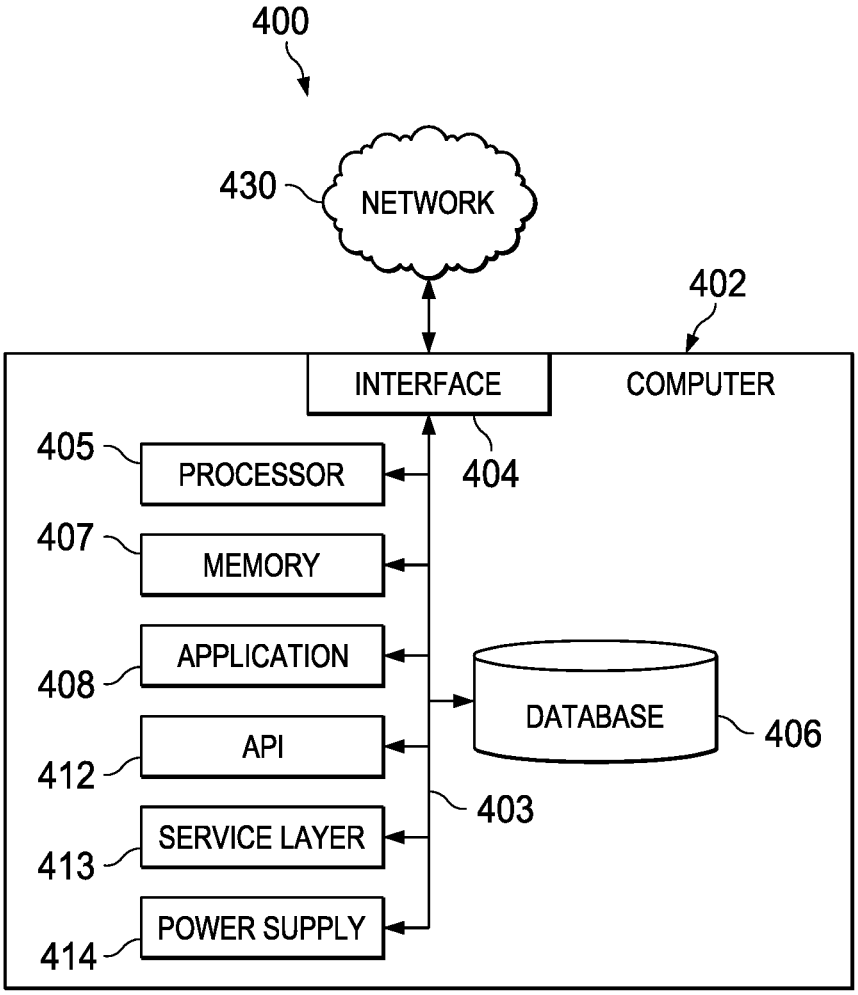
FIG. 4 is a block diagram illustrating an example computer system used to provide computational functionalities associated with described algorithms, methods, functions, processes, flows, and procedures as described in the present disclosure, according to some implementations of the present disclosure.

FIG. 4 is a block diagram of an example computer system 400 used to provide computational functionalities associated with described algorithms, methods, functions, processes, flows, and procedures described in the present disclosure, according to some implementations of the present disclosure. The illustrated computer 402 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a graphical user interface (UI) (or GUI).

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a top level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both) over the system bus 403. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs.

The service layer 413 can provide software services to the computer 402 and other components (whether illustrated or not) that are communicably coupled to the computer 402. The functionality of the computer 402 can be accessible for all service consumers using this service layer. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 also includes a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

The application 408 can be an algorithmic software engine providing functionality according to particular needs, desires, or particular implementations of the computer 402 and the described functionality. For example, application 408 can serve as one or more components, modules, or applications. Further, although illustrated as a single application 408, the application 408 can be implemented as multiple applications 408 on the computer 402. In addition, although illustrated as internal to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power-supply 414 can include a power plug to allow the computer 402 to be plugged into a wall socket or a power source to, for example, power the computer 402 or recharge a rechargeable battery.

There can be any number of computers 402 associated with, or external to, a computer system containing computer 402, with each computer 402 communicating over network 430. Further, the terms "client," "user," and other appropriate terminology can be used interchangeably, as appropriate, without departing from the scope of the present disclosure. Moreover, the present disclosure contemplates that many users can use one computer 402 and one user can use multiple computers 402.

Described implementations of the subject matter can include one or more features, alone or in combination.

For example, in a first implementation, a computer-implemented method includes the following. A measured gas-oil rate (GOR) is determined for an oil well. A measured water cut (WC) is determined for the oil well. An initial solution of the GOR is determined for the oil well. A corrected WC is determined for the oil well based on a function of the measured GOR, the measured WC, and the initial solution of the GOR.

The foregoing and other described implementations can each, optionally, include one or more of the following features:

A first feature, combinable with any of the following features, the method further including: utilizing a pressure/volume/temperature (PVT) study on the oil well; and determining a proper initial solution GOR based on the PVT study.

A second feature, combinable with any of the previous or following features, where determining the measured GOR for the oil well includes determining the measured GOR when the oil well is operated in under-saturated conditions.

A third feature, combinable with any of the previous or following features, the method further including correcting the graph relating values of phases of the oil well, including a water phase, an oil phase, and a gas phase.

A fourth feature, combinable with any of the previous or following features, where the graph relating the values of phases of the oil well includes tie-lines connecting pairs of 100 percent points of the phases.

A fifth feature, combinable with any of the previous or following features, where determining the corrected WC includes determining a ceiling value for the corrected WC when the function produces a corrected WC above the ceiling value.

A sixth feature, combinable with any of the previous or following features, where determining the corrected WC includes determining a floor value for the corrected WC when the function produces a corrected WC below the floor value.

In a second implementation, a non-transitory, computer-readable medium stores one or more instructions executable by a computer system to perform operations including the following. A measured gas-oil rate (GOR) is determined for an oil well. A measured water cut (WC) is determined for the oil well. An initial solution of the GOR is determined for the oil well. A corrected WC is determined for the oil well based on a function of the measured GOR, the measured WC, and the initial solution of the GOR.

The foregoing and other described implementations can each, optionally, include one or more of the following features:

A first feature, combinable with any of the following features, the operations further including: utilizing a pressure/volume/temperature (PVT) study on the oil well; and determining a proper initial solution GOR based on the PVT study.

A second feature, combinable with any of the previous or following features, where determining the measured GOR for the oil well includes determining the measured GOR when the oil well is operated in under-saturated conditions.

A third feature, combinable with any of the previous or following features, the operations further including correcting the graph relating values of phases of the oil well, including a water phase, an oil phase, and a gas phase.

A fourth feature, combinable with any of the previous or following features, where the graph relating the values of phases of the oil well includes tie-lines connecting pairs of 100 percent points of the phases.

A fifth feature, combinable with any of the previous or following features, where determining the corrected WC includes determining a ceiling value for the corrected WC when the function produces a corrected WC above the ceiling value.

A sixth feature, combinable with any of the previous or following features, where determining the corrected WC includes determining a floor value for the corrected WC when the function produces a corrected WC below the floor value.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. A measured gas-oil rate (GOR) is determined for an oil well. A measured water cut (WC) is determined for the oil well. An initial solution of the GOR is determined for the oil well. A corrected WC is determined for the oil well based on a function of the measured GOR, the measured WC, and the initial solution of the GOR.

The foregoing and other described implementations can each, optionally, include one or more of the following features:

A first feature, combinable with any of the following features, the operations further including: utilizing a pressure/volume/temperature (PVT) study on the oil well; and determining a proper initial solution GOR based on the PVT study.

A second feature, combinable with any of the previous or following features, where determining the measured GOR for the oil well includes determining the measured GOR when the oil well is operated in under-saturated conditions.

A third feature, combinable with any of the previous or following features, the operations further including correcting the graph relating values of phases of the oil well, including a water phase, an oil phase, and a gas phase.

A fourth feature, combinable with any of the previous or following features, where the graph relating the values of phases of the oil well includes tie-lines connecting pairs of 100 percent points of the phases.

A fifth feature, combinable with any of the previous or following features, where determining the corrected WC includes determining a ceiling value for the corrected WC when the function produces a corrected WC above the ceiling value.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EE- PROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method, comprising:

determining a gas-oil rate (GOR) for an oil well measured before water injection;

determining a measured water cut (WC) for the oil well;

determining an initial solution GOR for the oil well;

determining a corrected WC for the oil well based on a function comprising a difference between a ceiling value and a ratio of the GOR relative to the measured WC, and the initial solution GOR;

presenting, in a user interface based on the corrected WC for the oil well, suggestions for implementing improvements in production at the oil well, comprising suggestions for changes to parameters used in drilling at the oil well;

receiving, through the user interface, user selections of the suggestions for changes to parameters; and implementing, using the user selections to parameters, changes in drilling at the oil well.

2. The computer-implemented method of claim 1, further comprising:

utilizing a pressure/volume/temperature (PVT) study on the oil well; and determining a proper initial solution GOR based on the PVT study.

3. The computer-implemented method of claim 1, wherein determining the measured GOR for the oil well comprises determining the measured GOR when the oil well is operated in under-saturated conditions.

4. The computer-implemented method of claim 1, further comprising correcting a graph relating values of phases of the oil well, comprising a water phase, an oil phase, and a gas phase.

5. The computer-implemented method of claim 4, wherein the graph relating the values of phases of the oil well comprises tie-lines connecting pairs of 100 percent points of the phases.

6. The computer-implemented method of claim 1, wherein determining the corrected WC comprises determining the ceiling value for the corrected WC when the function produces a corrected WC above the ceiling value.

7. The computer-implemented method of claim 1, wherein determining the corrected WC comprises determining a floor value for the corrected WC when the function produces a corrected WC below the floor value.

8. A non-transitory, computer-readable medium storing one or more instructions executable by a computer system to perform operations comprising:

determining a gas-oil rate (GOR) for an oil well measured before water injection;

determining a measured water cut (WC) for the oil well;

determining an initial solution GOR for the oil well;

determining a corrected WC for the oil well based on a function comprising a difference between a ceiling value and a ratio of the GOR relative to the measured WC, and the initial solution GOR;

presenting, in a user interface based on the corrected WC for the oil well, suggestions for implementing improvements in production at the oil well, comprising suggestions for changes to parameters used in drilling at the oil well;

receiving, through the user interface, user selections of the suggestions for changes to parameters; and implementing, using the user selections to parameters, changes in drilling at the oil well.

9. The non-transitory, computer-readable medium of claim 8, the operations further comprising:

utilizing a pressure/volume/temperature (PVT) study on the oil well; and determining a proper initial solution GOR based on the PVT study.

10. The non-transitory, computer-readable medium of claim 8, wherein determining the measured GOR for the oil well comprises determining the measured GOR when the oil well is operated in under-saturated conditions.

11. The non-transitory, computer-readable medium of claim 8, the operations further comprising correcting a graph relating values of phases of the oil well, comprising a water phase, an oil phase, and a gas phase.

12. The non-transitory, computer-readable medium of claim 11, wherein the graph relating the values of phases of the oil well comprises tie-lines connecting pairs of 100 percent points of the phases.

13. The non-transitory, computer-readable medium of claim 8, wherein determining the corrected WC comprises determining the ceiling value for the corrected WC when the function produces a corrected WC above the ceiling value.

14. The non-transitory, computer-readable medium of claim 8, wherein determining the corrected WC comprises determining a floor value for the corrected WC when the function produces a corrected WC below the floor value.

15. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

determining a gas-oil rate (GOR) for an oil well measured before water injection;

determining a measured water cut (WC) for the oil well;

determining an initial solution GOR for the oil well;

determining a corrected WC for the oil well based on a function comprising a difference between a ceiling value and a ratio of the GOR relative to the measured WC, and the initial solution GOR;

presenting, in a user interface based on the corrected WC for the oil well, suggestions for implementing improvements in production at the oil well, comprising suggestions for changes to parameters used in drilling at the oil well;

receiving, through the user interface, user selections of the suggestions for changes to parameters; and implementing, using the user selections to parameters, changes in drilling at the oil well.

16. The computer-implemented system of claim 15, the operations further comprising:

utilizing a pressure/volume/temperature (PVT) study on the oil well; and determining a proper initial solution GOR based on the PVT study.

17. The computer-implemented system of claim 15, wherein determining the measured GOR for the oil well comprises determining the measured GOR when the oil well is operated in under-saturated conditions.

18. The computer-implemented system of claim 15, the operations further comprising correcting a graph relating values of phases of the oil well, comprising a water phase, an oil phase, and a gas phase.

19. The computer-implemented system of claim 18, wherein the graph relating the values of phases of the oil well comprises tie-lines connecting pairs of 100 percent points of the phases.

20. The computer-implemented system of claim 15, wherein determining the corrected WC comprises determining the ceiling value for the corrected WC when the function produces a corrected WC above the ceiling value.

* * * * *